United States Patent [19]

Kosugi

[11] Patent Number: 4,718,451

[45] Date of Patent: Jan. 12, 1988

[54] DIRECTIONAL CONTROL VALVE

[75] Inventor: Seiji Kosugi, Soka, Japan

[73] Assignee: Shoketsu Kinzoku Kogyo Kabushiki Kaisha, Tokyo, Japan

[21] Appl. No.: 166

[22] Filed: Jan. 2, 1987

Related U.S. Application Data

[63] Continuation-in-part of Ser. No. 757,439, Jul. 22, 1985, abandoned.

[30] Foreign Application Priority Data

Dec. 18, 1984 [JP] Japan ..... 59-191890

[51] Int. Cl.[4] ..... F15B 13/08

[52] U.S. Cl. ..... 137/596.16; 137/596.18; 137/884; 137/885

[58] Field of Search ..... 137/596.16, 596.18, 137/884, 885

[56] References Cited

U.S. PATENT DOCUMENTS

| | | | |
|---|---|---|---|
| 3,530,897 | 9/1970 | Buchanan | 137/884 X |
| 3,603,348 | 9/1979 | Wright | 137/596.16 X |
| 3,918,488 | 11/1975 | Minami | 137/596.16 |
| 3,918,489 | 11/1975 | Foster et al. | 137/596.16 |
| 3,982,726 | 9/1976 | Bublitz et al. | 251/129.11 |
| 4,082,108 | 4/1978 | Dininio | 137/596.16 X |
| 4,100,937 | 7/1978 | Mallory | 137/596.16 |
| 4,453,565 | 6/1984 | Neff | 137/596.16 |
| 4,640,309 | 2/1987 | Hoffman et al. | 137/596.18 |

FOREIGN PATENT DOCUMENTS

| | | | |
|---|---|---|---|
| 46558 | 11/1972 | Japan | 137/884 |

*Primary Examiner*—Gerald A. Michalsky

*Attorney, Agent, or Firm*—Oblon, Fisher, Spivak, McClelland & Maier

[57] ABSTRACT

An improvement to reduce the size of a directional control valve by providing a plurality of pilot spool valves in a single valve casing. A plurality of valve mechanisms are juxtaposed in a monolithic valve casing by individually inserting valve members in a plurality of parallel valve bores provided in the valve casing. A plurality of cylinders corresponding to the valve bores are pierced in an intermediate plate mounted on the valve casing from that face which comes in contact with the valve casing. The cylinders communicate with each other by means of grooves cut in the aforementioned contacting face and open into the atmosphere through a relief port. The adjoining cylinders are thus brought closer, and the valve bodies are driven by pilot fluid pressure that act on the pistons fitted in the individual cylinders.

9 Claims, 6 Drawing Figures

DIRECTIONAL CONTROL VALVE

The present application is a continuation-in-part of U.S. patent application Ser. No. 757,439 filed on July 22, 1985, now abandoned.

BACKGROUND OF THE INVENTION

1. Field of the Invention

This invention relates to a directional control valve for use with industrial machines operated by fluid pressure.

2. Description of the Prior Art

With small-sized directional control valves of known types, one valve casing generally contains one each valve mechanism. To mount a plurality of directional control valves on a base or the like, therefore, a corresponding number of mounting bolts and receiving tapped holes in the base have been required.

The size of such conventional directional control valves has been difficult to reduce beyond a certain limit because each valve must have a large enough casing to provide one or more mounting holes therein. It has also been difficult to reduce the size of their mounting bases since appropriate intervals must be left between the individual valve casings mounted thereon.

Miniaturization of such directional control valves can be achieved to a certain extent by juxtaposing a plurality of valve mechanisms in one valve casing, thereby reducing the space for the mounting holes that have conventionally been required by each valve and also the intervals between the individual valve mechanisms. Even then, valve mechanisms cannot be placed too close to each other for avoiding leakage of hydraulic fluid flowing therebetween.

SUMMARY OF THE INVENTION

A principal object of this invention is to provide a directional control valve of smaller size than ever that is obtainable by reducing the size of a known directional control valve comprising a plurality of valve mechanisms contained in a single valve casing for the purpose of space saving through the improvement of valve structure.

In a spool valve operated by the fluid pressure supplied from a pilot valve, the piston thereof is generally made to have a larger diameter than the valve body because of the need to obtain large enough force to drive the valve body. In attempting to achieve valve size reduction by containing a plurality of such pilot-driven valve mechanisms in a single valve casing, one of the major problems to be solved is how to place the pistons that drive the individual valve bodies close to each other.

Another object of this invention is to provide a directional control valve having an intermediate plate in which cylinders to contain the pistons are spaced away from each other only at very small distances.

Still another object of this invention is to provide a directional control valve which comprises a valve casing, which is substantially a rectangular solid in shape, having a plurality of parallel valve bores pierced between a pair of opposite faces thereof. Another series of bores communicating with said valve bores are also pierced from one face of the rectangular solid that is parallel to the valve bores, thereby providing a power output port, a pressure exhaust port and a pressure supply port and, at the same time, forming a power output chamber, a pressure exhaust chamber and a pressure supply chamber in the valve bores. This design not only greatly simplifies the structure of a valve block but also facilitates the manufacturing thereof.

Yet another object of this invention is to provide a directional control valve that can be made with high efficiency through a reduction in the number of working processes in the making of a valve casing by bringing the pressure supply chambers of a plurality of juxtaposed valve mechanisms into communication with each other to provide a common pressure supply chamber.

The foregoing objects of this invention are achieved as follows: A directional control valve according to this invention comprises a monolithic valve casing pierced with a plurality of parallel valve bores and a plurality of pilot-driven valve mechanisms. Each valve mechanism has spool valves that are inserted in the valve bores and switched by pistons driven by pilot fluid pressure between one position where the pressure fluid fed from a pressure supply port is discharged to a power output port and another position where the pressure fluid from the power output port is discharged to a pressure exhaust port. The valve casing is a block having the plurality of parallel valve bores pierced between a pair of opposite faces thereof and bores to provide the pressure supply, power output and pressure exhaust ports pierced in the direction perpendicular to said series of valve bores. An intermediate plate is fastened to one end surface of the valve casing where the valve bores open. The intermediate plate has a plurality of cylinders corresponding to the valve bores and opening on that side thereof which faces the valve casing. The cylinders are brought into communication with each other by grooves cut on said side of the intermediate plate facing the valve casing, while being opened into the atmosphere through a relief port provided in the outer wall of the intermediate plate. A piston is slidably fitted in each cylinder and brought in contact with the end surface of a valve body inserted in the corresponding valve bore, with a pilot chamber being provided on the inner-end side of the cylinder. A plurality of pilot valves to supply pilot pressure fluid to the pilot chambers are provided on the intermediate plate.

In the directional control valve of this invention just described, a valve casing has a plurality of valve bores pierced side by side, in each of which an independent valve body is inserted. Thus, a plurality of valve mechanisms are juxtaposed in a single valve casing. The partition walls between the adjoining valve bores need not have any greater strength than is required for withstanding the pressure of a fluid flowing into such bores. The partition walls need not be as strong as the outer walls of the valve bores at both ends that have to keep up the shape of the whole casing and withstand forces applied from outside. Accordingly, this design permits a remarkable size reduction, compared with an assembly which comprises a plurality of conventional directional control valves each of which consists of a valve mechanism contained in one each valve casing.

While a plurality of parallel valve bores are pierced in a single valve casing, a pressure support port, a power output port and a pressure exhaust port are provided in the direction perpendicular to said bores. This design not only simplifies the structure of the valve casing but also facilitates its manufacturing.

A directional control valve of this invention also has an intermediate plate fastened to one end surface of the valve casing thereof. The intermediate plate has a plurality of cylinders corresponding to said valve bores, with the cylinders being pierced from that side thereof which faces the valve casing. The cylinders are brought into communication with each other by grooves cut on said side of the intermediate plate facing the valve casing, while being opened into the atmosphere through a relief port provided in the outer wall of the intermediate plate. This design is also conducive to reducing the overall size of the valve.

In reducing to a minimum the size of a valve casing in which a plurality of parallel valve bores are provided to insert a corresponding number of spool valves driven by pilot fluid pressure, one of the major problems that confront is how to reduce the intervals between the individual cylinders because there is also the general need of making the diameter of such pistons somewhat larger than the diameter of the valve bodies in order to derive the required valve driving force from the pilot fluid pressure.

On the other hand, the aforementioned intermediate plate, which has a plurality of cylinders pierced from that end which comes in contact with the valve casing, eliminates the need to provide sealing between the individual cylinders because the cylinders communicate with each other by means of the connecting grooves and opens into the atmosphere through the relief port. This permits bringing the adjoining cylinders much closer to each other than in a valve casing of the known type in which cylinders are separated from each other by means of sealing material so as to keep them immune to the adverse effect of pressure. Provision of the pilot chamber at the inner end of the cylinder also helps keep up the strength of the cylinder wall against the pressure exerted from the pilot chamber.

The aforementioned and other objects, structures and effects of this invention will become apparent from the following detailed description of preferred embodiments of the invention given with reference to the accompanying drawings. The examples given below are simply preferred embodiments to which this invention is by no means limited.

DESCRIPTION OF THE PREFERRED EMBODIMENTS

Figure 1:
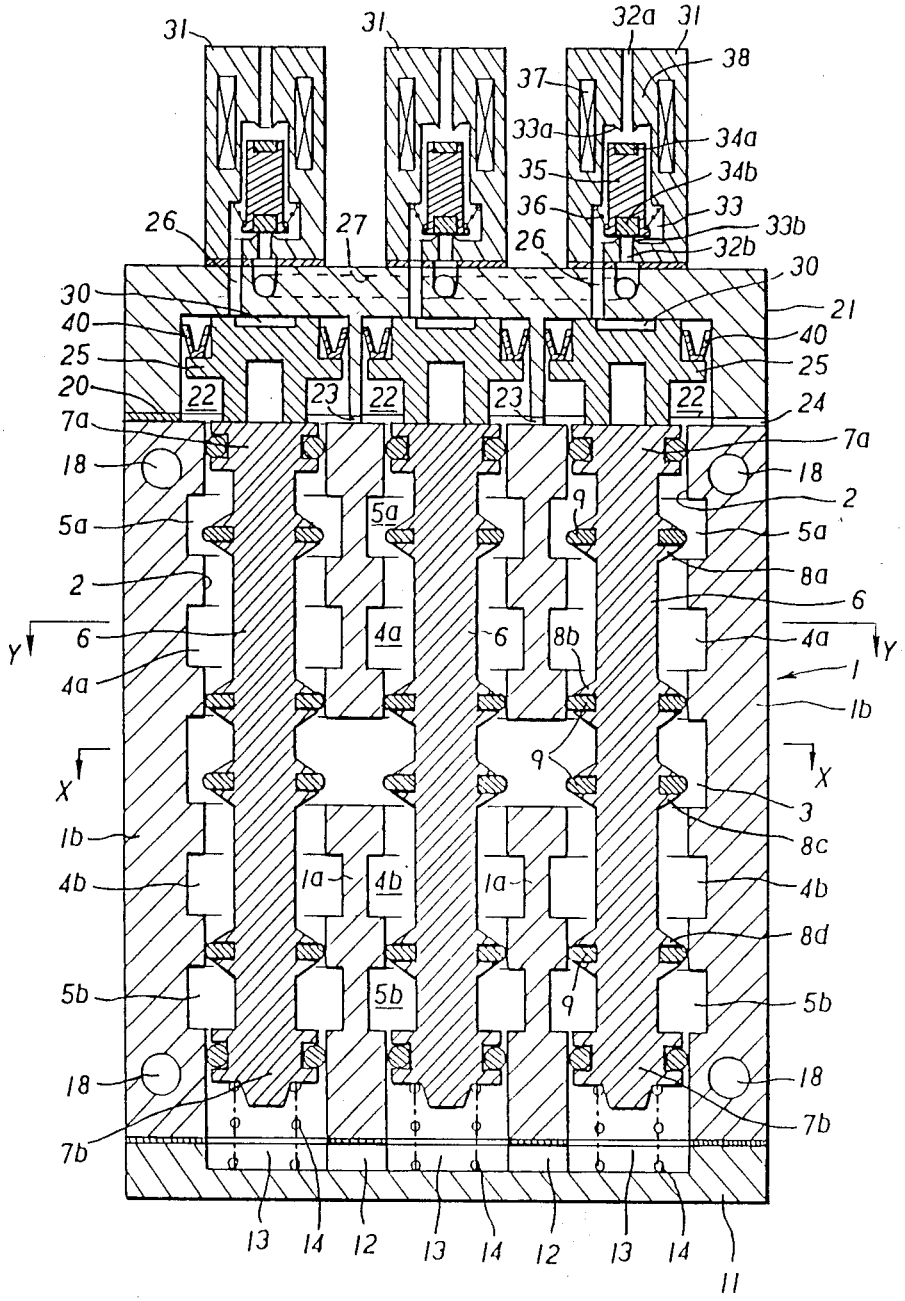
FIG. 1 is a cross-sectional front view of a first embodiment of this invention.
Figure 2A:
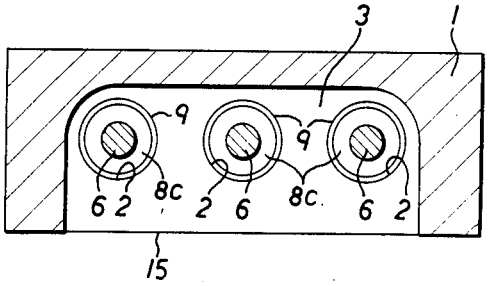
FIGS. 2A and 2B show cross-sectional views taken along the lines X—X and Y—Y of FIG. 1 at (A) and (B), respectively.
Figure 2B:
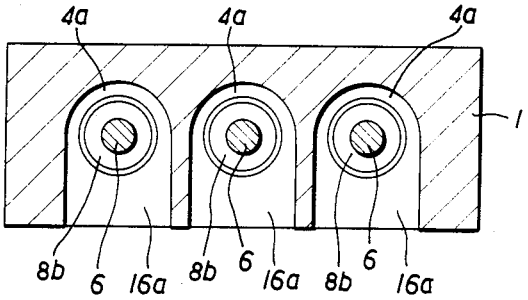

FIG. 1 shows a first embodiment of this invention which comprises a valve casing 1 pierced through with three vertical valve bores 2 each of which has a pressure supply chamber 3 in the middle thereof, with power output chambers 4*a* and 4*b* and pressure exhaust chambers 5*a* and 5*b* symmetrically disposed on both sides of said pressure supply chamber 3. As is clearly shown in FIG. 2 (A), the pressure supply chambers 3 of the individual valve bores communicate with each other to constitute a common pressure supply chamber.

A valve body 6 is slidably inserted in each of the valve bores 2 whose both ends are sealed by flanges 7*a* and 7*b* each carrying an O-ring thereon. Circular valve portions 8*a*, 8*b*, 8*c* and 8*d* are provided at intervals between the flanges 7*a* and 7*b*, with a sealing member 9 being fitted in a groove cut around the periphery of each valve portion. The circular valve portions 8*a*, 8*b*, 8*c* and 8*d* on the valve body 6 are disposed in such a manner that the power output chamber 4*a* and pressure exhaust chamber 5*a* and the pressure supply chamber 3 and power output chamber 4*b* are respectively brought into communication while the pressure supply chamber 3 and power output chamber 4*a* and the power output chamber 4*b* and pressure exhaust chamber 5*b* are respectively disconnected on the return stroke of the valve body 6. Meanwhile, the pressure supply chamber 3 and power output chamber 4*a* and the power output chamber 4*b* and pressure exhaust chamber 5*b* are respectively brought into communication while the pressure supply chamber 3 and power output chamber 4*b* and the power output chamber 4*a* and pressure exhaust chamber 5*a* are respectively disconnected on the driving stroke of the valve body 6.

A partition wall 1*a* between the adjoining valve bores 2 in the valve casing 1 serves its purpose if it is strong enough to withstand the sliding motion of the valve body 6 and the pressure of fluid flowing into the valve bores 2 on both sides thereof. Unlike the outer walls 1*b* defining the valve bores 2 at both ends, the partition wall 1*a* need not have such strength as is great enough to maintain the overall shape of the assembly or to withstand any force exerted from outside. This permits drastically reducing the thickness of the individual partition walls 1*a* and, therefore, making the whole valve casing 1 much smaller than one that contains three independent directional control valves placed side by side.

The valve casing 1 is made of metal or synthetic resin that is formed into a block shaped substantially like a rectangular solid, with a plurality of parallel valve bores 2 pierced between a pair of opposite faces thereof. A required number of bores extending perpendicularly to and reaching each of said valve bores 2 are pierced from a face that is parallel thereto, whereby not only a plurality of power output ports 16*a* and 16*b* and pressure exhaust ports 17*a* and 17*b* and a single pressure supply port 15 but also said power output chambers 4*a* and 4*b*, pressure exhaust chambers 5*a* and 5*b* and pressure supply chamber 3 in the valve bores are formed. To provide the power output chambers 4*a* and 4*b* and pressure exhaust chambers 5*a* and 5*b* at the same time, the power output ports 16*a* and 16*b* and the pressure exhaust ports 17*a* and 17*b* are made larger than the valve bore 2 (see FIG. 2 (B)), while the size of the pressure supply port 15 is equal to or larger than the common pressure supply chamber 3 (see FIG. 2 (A)).

All bores and ports, which are provided either by machining from outside the valve casing 1 or by die-casting, extend inward from the surface of the valve casing, either straight or, at least, growing progressively smaller in diameter toward the center. This permits greatly simplifying the design of the valve casing and facilitates its manufacturing.

Figure 3:
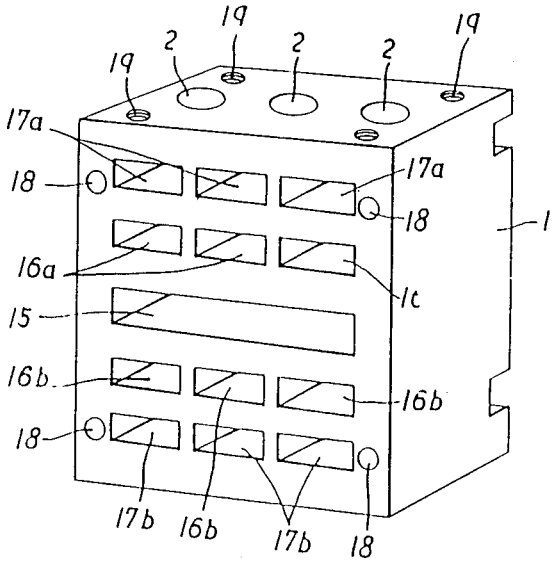
FIG. 3 is a schematic perspective view of a valve casing of the first embodiment.

As is shown in FIG. 3, the pressure supply port 15 communicating with the common pressure supply chamber 3 shared by the individual valve ports 2, the multiplicity of power output ports 16*a* and 16*b* respectively communicating with the power output chambers 4a and 4b in each valve port 2 and the multiplicity of pressure exhaust ports 17a and 17b respectively communicating with the pressure exhaust chambers 5a and 5b therein are pierced from the surface of the valve casing 1. Mounting holes 18 for use in fixing the valve casing 1 on a base or the like are provided at the four corners thereof. Also, tapped holes 19 for use in attaching an intermediate plate 21 to be described later are provided in one end surface of the valve casing 1.

The embodiment shown in FIG. 3 has the multiplicity of pressure exhaust ports 17a and 17b which respectively communicate with the pressure exhaust chambers 5a and 5b in each valve mechanism. But the number of such pressure exhaust ports may be reduced to two, as with the pressure supply port 15 shown in FIG. 2 (A); in which case a first common pressure exhaust port is shared by the pressure exhaust chambers 5a of the individual valve mechanisms and a second common pressure exhaust port is shared by the pressure exhaust chambers 5b of the individual valve mechanisms.

To one end of said valve casing 1 is attached a common keep plate 11 using bolts or other appropriate fastening means, with a sheet-formed sealing material interposed therebetween. A return spring chamber 13 is provided between the keep plate 11 and the flange 7b of each valve body 6. The individual return spring chambers 13 communicate with each other by means of communicating passages 12 provided on the keep plate 11. Each chamber 13 contains a spring 14 that urges the valve body 6 in the returning direction. If necessary, fluid pressure may be supplied to the return spring chamber 13 so that a greater urging force is generated through the combination of the spring force and fluid pressure.

The intermediate plate 21 is fastened to one end surface of the valve casing 1 through a sheet-formed packing 20 by means of bolts screwed into said tapped holes 19. The intermediate plate 21 has three cylinders 22 pierced from that side thereof which comes in contact with the valve casing 1. The cylinders 22 communicate with each other by means of grooves 23 cut in the contacting surface of the intermediate plate 21 and open into the atmosphere through a relief port 24 provided in the outer wall of the intermediate plate 21. A piston 25 slidably fitted in each cylinder 22 comes in contact with the end surface of the valve body 6, defines a pilot chamber 30 at the inner end of the cylinder 22, and pressed in the returning direction by the valve body 6 that is urged by said spring 14.

In reducing to a minimum the size of the valve casing 1 in which a plurality of parallel valve bores 2 are provided to insert a corresponding number of spool valves, one of the major problems that confront is how to reduce the intervals between the individual cylinders 22 because there is also the general need of making the diameter of the pistons 25 somewhat larger than the diameter of the valve bodies 6 in order to obtain the required valve driving force.

In this respect, the aforementioned intermediate plate 21 is designed to effectively reduce the intervals between the individual cylinders. The intermediate plate 21, which has a plurality of cylinders 22 pierced from that end thereof which comes in contact with the valve casing 1, eliminates the need to provide sealing between the individual cylinders 22 because the cylinders communicate with each other by means of the connecting grooves 23 and opens into the atmosphere through the relief port 24. This permits bringing the adjoining cylinders much closer to each other than in a valve casing of the known type in which cylinders are separated from each other by means of sealing material so as to keep them immune to the adverse effect of pressure. In such a conventional valve casing, each partition wall must have a thickness of 2 mm minimum since there is the need to hold the sealing material between the adjoining walls against the force exerted by pressurized fluid. Provision of the pilot chamber 30 at the inner end of the cylinder 22 also helps keep up the strength of the cylinder wall against the pressure exerted from the pilot chamber 30. As a consequence, adjoining cylinders can be brought close to each other within such a limit that the pressure from the pilot chamber 30 is safely withstood. Even if adjoining cylinders are brought close enough, it is only in a limited portion (on the line connecting the centers of the two cylinders) of a very small area that the intervening wall becomes very thin. Therefore, the wall can retain considerably great strength.

Three solenoid pilot valves 31 are mounted on the intermediate plate 21, with a sheet-formed sealing material interposed therebetween. Each pilot valve 31 has a valve chamber 33 that communicates with a pilot chamber 30 in each cylinder 22 by means of a connecting port 26 pierced through the end wall of the intermediate plate 21.

The pilot valve 31 has through holes 32a and 32b provided at both ends of the valve chamber 33, with the inner ends of the through holes 32a and 32b serving as valve seats 33a and 33b. A movable valve 35 having valve members 34a and 34b at both ends thereof is inserted in the valve chamber 33. The movable valve 35 is normally urged toward the valve seat 33b by a spring 36 provided in the valve chamber. When an exciting coil 37 around the movable valve 35 is energized, the movable valve 35 constituting an armature is attracted to a stator core 38 surrounding the through hole 32a against the force of the spring 36.

While the other end of the through holes 32a opens into the atmosphere, the other end of the through holes 32b communicates with a common pilot pressure passage 27 provided in the intermediate plate 21. The pilot pressure passage 27 is connected to a pressure fluid source together with said pressure supply chamber 3. A seal member 40 is provided on a piston 25 to seal between opposite sides of a piston 25.

When the directional control valve just described is in the state shown in FIG. 1, the valve seat 33b of the pilot valve 31 is closed by the valve member 34b of the movable valve 35 urged by the spring 36, with the valve chamber 33 opening into the atmosphere through the through hole 32a. Therefore, each valve body 6 is returned to the original position by the urging force of the spring 14, with the pressure supply chamber 3 and power output chamber 4b being brought into communication with each other while pressure fluid flows outside from the power output port 16b through the power output chamber 4b (see FIG. 3).

If the exciting coil 37 of a pilot valve 31 is energized in the condition shown in FIG. 1, the movable valve 35 is attracted to the stator core 38 against the urging force of the spring 36, with the valve member 34b closing the valve seat 33a and the valve member 34b opening the valve seat 33b. This causes pilot pressure fluid to flow from the pilot pressure passage 27 in the intermediate plate 21 into the valve chamber 33 through the through hole 32*b*, and then further into the pilot chamber 30 of the cylinder 22 through the connecting hole 26.

Consequently, the pilot fluid pressure in the pilot chamber 30 drives the piston 25, thereby moving the valve body 6 against the urging force of the spring 14. Thus, the pressure fluid from the pressure supply chamber 3 is switched to the power output chamber 4*d*, thence flowing outside through the power output port 16*a* (see FIG. 3).

When the exciting coil 37 is de-energized, the movable valve is returned to the original position by the urging force of the spring 36, whereupon the valve member 34*b* closes the valve seat 33*b* to cut off the inflow of the pilot pressure fluid while the valve member 34*a* opens the valve seat 33*b* to open the valve chamber 33 into the atmosphere. When the inflow of the pilot pressure fluid into the pilot chamber 30 is thus cut off, the valve body 6 returns to the condition shown in FIG. 1 by the urging force of the spring 14, whereupon the pressuire fluid from the pressure supply chamber 3 is switched to the power output port 4*b*.

In the directional control valve just described, the individual valve bodies 6 can of course be operated separately by individually energizing the exciting coil 37 of each pilot valve 31.

Figure 4:
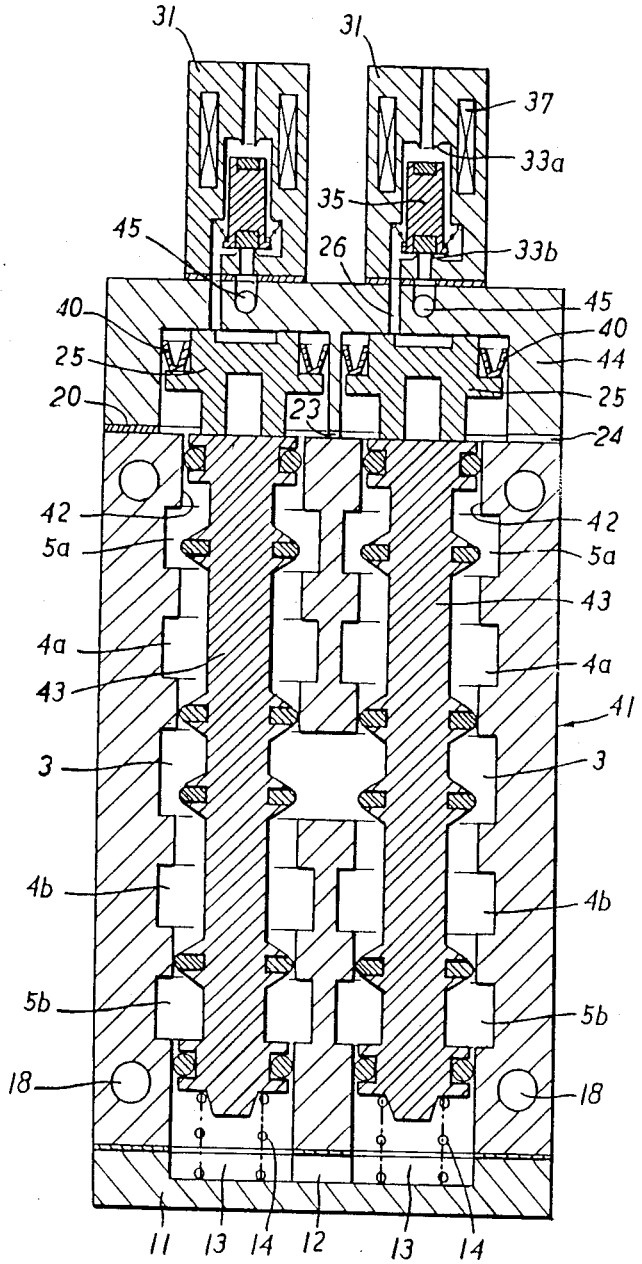
FIG. 4 is a cross-sectional front view of a second embodiment of this invention.

FIG. 4 shows a second embodiment of this invention, in which a valve casing 41 has two valve bores 42, each of which accommodates a valve body 43, and two pilot valves 31. But no pilot pressure passage like the one 27 in the previously described first embodiment is provided in an intermediate plate 44. The pilot fluid pressure to the pilot valves 31 is individually supplied through openings 45 in the intermediate plate 44.

In FIG. 4, the parts which are the same as or corresponding to those shown in FIG. 1 are designated by the same reference characters.

Figure 5:
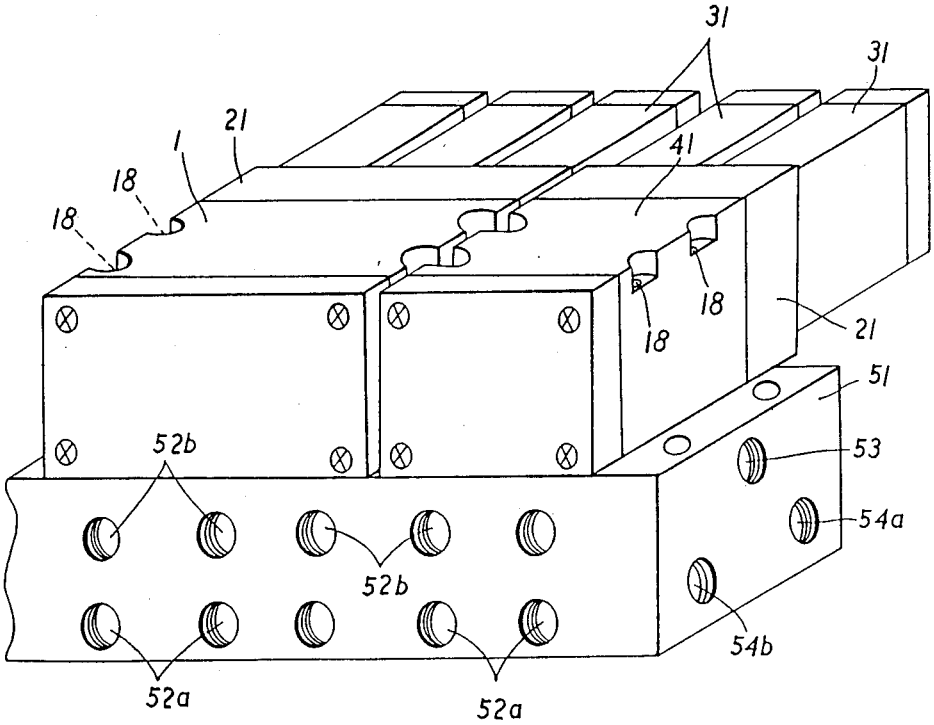
FIG. 5 is a perspective view showing an example of a directional control valve according to this invention in use.

FIG. 5 shows an example of a directional control valve of this invention in service. Two directional control valves, which are the first and second preferred embodiments of this invention, are mounted on a base 51. The valve bodies 1 and 4, in each of which a plurality of valves are juxtaposed, are fixed to the manifold base 51 by means of the mounting holes 18.

The manifold base 51 has a number of power output ports 52*a* and 52*b* for the individual power output ports of each valve mechanism. Meanwhile, a power supply port 53 is common to all valve mechanisms, and pressure exhaust ports 54*a* and 54*b* are respectively common to the pressure exhaust ports 17*a* and 17*b* of each valve mechanism (see FIG. 3). Instead of using the manifold base 51, pressure fluid may also be supplied and discharged directly through the individual ports.

The pilot valve 31 may also be actuated by mechanical force or fluid pressure, instead of electromagnetic force.

Although the two embodiments described above have five ports, a directional control valve of this invention may have three or four ports as long as each of a plurality of juxtaposed valve mechanisms has individually separated power output ports.

What is claimed is:

1. In a directional control valve having a plurality of pilot-driven valve mechanisms which comprises a casing pierced with a plurality of parallel valve bores and a corresponding number of spool valve bodies inserted therein, each of the spool valve bodies being switched by a piston driven by pilot fluid pressure between one position where the pressure fluid fed from a pressure supply port is discharged to a power output port and another position where the pressure fluid from the power output port is discharged to a pressure exhaust port, the improvement which comprises a valve casing that is a monolithic block having said plurality of parallel valve bores pierced between a pair of opposite faces thereof and bores to provide the pressure supply, power output and pressure exhaust ports pierced in the direction perpendicular to said series of valve bores, an intermediate plate fastened to one end surface of the valve casing where the valve bores open, the intermediate plate having a plurality of cylinders corresponding to the valve bores and opening on that side thereof which faces the valve casing, the cylinders being brought into communication with each other by grooves cut on said side of the intermediate plate facing the valve casing, while being opened into the atmosphere through a relief port provided in the outer wall of the intermediate plate, a piston that is slidably fitted in each cylinder and brought in contact with the end surface of a valve body inserted in the corresponding valve bore, a pilot chamber that is provided on the inner-end side of the cylinder, and a plurality of pilot valves to supply pilot pressure fluid to the pilot chambers provided on said intermediate plate.

2. A directional control valve according to claim 1, in which the outer wall of a valve bore positioned at each end of the valve casing has a large enough thickness to retain the overall shape of the valve casing and withstand forces exerted from outside and partition walls between adjoining bores have a thickness smaller than that of said outer wall.

3. A directional control valve according to claims 1 or 2, in which mounting holes are provided in the outer wall of said valve bore positioned at each end of the valve casing.

4. A directional control valve according to claim 3 in which said mounting holes extend to one side.

5. A directional control valve according to claims 1 or 2 in which said mounting holes extend to said one side.

6. A directional control valve according to claim 1, in which a return spring is interposed between a keep plate attached to one end of the valve casing which is opposite to the end to which said intermediate plate is attached and the valve body.

7. A directional control valve according to claim 1, in which solenoid pilot valves to drive said pistons provided in the intermediate plate by pilot fluid are provided in such positions as correspond to the individual pistons and power output ports thereof are brought into communication with said pilot chambers by means of bores provided in the intermediate plate.

8. A directional control valve according to claim 7, in which pilot pressure supply ports are provided in the intermediate plate to supply pilot pressure fluid to said pilot valves.

9. A directional control valve according to claim 8, in which said pilot valves are brought into communication with the pilot pressure supply ports by means of a common pilot pressure passage provided in the intermediate plate.

* * * * *